United States Patent [19]

Hirayama et al.

[11] 3,967,565

[45] July 6, 1976

[54] CLOTH FEEDING DEVICE FOR SEWING MACHINE AND METHOD THEREOF

[75] Inventors: Tetsuro Hirayama, Chofu; Kousuke Yuyama; Yoshihiko Matsuura, both of Tokyo, all of Japan

[73] Assignee: Juki Co., Ltd., Tokyo, Japan

[22] Filed: Feb. 20, 1975

[21] Appl. No.: 551,427

[52] U.S. Cl. ..... 112/208; 112/215

[51] Int. Cl.[2] ..... D05B 27/08

[58] Field of Search ..... 112/208, 215, 203, 204, 112/210–214, 158 A, 158 D

[56] References Cited

UNITED STATES PATENTS

| | | | |
|---|---|---|---|
| 2,790,331 | 4/1957 | Pinkvoss | 112/215 X |
| 3,534,696 | 10/1970 | Willenbacher et al. | 112/215 |

*Primary Examiner*—George V. Larkin

*Attorney, Agent, or Firm*—Basile and Weintraub

[57] ABSTRACT

A cloth feeding device for a sewing machine and a method of adjusting the differential ratio of feeding cloth, in any desired wide range, particularly, in an overlock sewing machine. There is disclosed herein a mechanism wherein a cloth feeding arm is engaged with a vertically feeding cam fixed to a main shaft and is further connected with an eccentric horizontally feeding cam. The feeding cam comprises a flanged cam member frictionally fixed to the main shaft and an internal surface cam externally fitting it through a link mechanism. The link mechanism comprises a horizontally feeding rocker arm and a horizontally feeding rod so that the horizontal feed of the cloth feeding arm may be simply and freely adjusted by varying the phase of the eccentric double cam with an operating piece which can be operated from outside the sewing machine frame. The present invention, also, also contemplates a method of obtaining a differential adjusting ratio of feeding cloth in a wide range by setting two of such adjusting mechanisms within a sewing machine frame so as to be able to be operated independently of each other and making the respective adjusted amounts correspond to each other by utilizing the possibility of the independent adjustment. Also disclosed is a device for achieving the method.

5 Claims, 7 Drawing Figures

CLOTH FEEDING DEVICE FOR SEWING MACHINE AND METHOD THEREOF

BACKGROUND OF THE INVENTION

Generally, in a cloth feeding mechanism of a sewing machine, the cloth feeding operation stroke is made adjustable.

Various kinds of contrivances are, presently, employed to adjust the cloth feeding operation stroke. For example, there is a system wherein an eccentric cam is exchanged. Also, there is a system wherein the distance of fitting a main shaft, eccentrically driving a horizontally feeding rod to the core, is adjusted.

In the system wherein the eccentric cam is exchanged, there is encountered the troublesome operation of replacing the cam. Also, a link mechanism allowing the replacement of the cam must be selected. This is very disadvantageous to the operation and design of the sewing machine.

In the system where the position of fitting the main shaft eccentrically driving the horizontally feeding rod to the core is adjusted, a very high precision is required for the manufacture of parts. Also, the link mechanism is so large as to be disadvantageous and inconvenient to the design of the sewing machine.

Furthermore, and with respect to an overlock sewing machine, such machine may or may not be provided with a main cloth feed and auxiliary cloth feed, as cloth feeding devices.

In the sewing machine provided with the main and auxiliary cloth feeding devices, it is required that the differential ratio be large enough; be freely adjustable between normal and reverse, and be simply adjusted by a means provided outside the machine frame. However, in a basic driving method already adopted in a differential cloth feeding device, power is transmitted from one cam to the main and auxiliary feeding arms through a link in which the distance between the fulcrum and operating point can be adjusted. Alternatively, two cams are used so as to respectively drive the main and auxiliary cloth feeding arms and are themselves exchanged to adjust the differential ratio.

In the former of such typical conventional methods, the link must be long so that the stroke, for adjusting the distance between the fulcrum and operating point, when transmitting the power to the main and auxiliary cloth feeding arms, may be along enough. This means that the operating mechanism part of the cloth feeding arm must be large. This inhibits the manufacture of small sewing machines. Moreover, only the operating stroke of the auxiliary cloth feed can be adjusted by operating a lever from outside the machine frame. Yet, the pivotal point of the link must be varied by inserting a spanner or the like into the narrow complicated cloth feeding link mechanism below the bed in order to adjust the main cloth feed. It has been very difficult, however, to make the differential ratio of the main and auxiliary cloth feeds large enough and still be able to obtain a reverse differential ratio, as used in the case of an extended sewing. In fact, in the case of such extended sewing, the maximum ratio has been about 1 : 1.4.

On the other hand, in the case of the latter method wherein the cams are exchanged, the work of exchanging the cams is still troublesome and is not desirable to the work efficiency.

SUMMARY OF THE INVENTION

The present invention provides a cloth feeding device for a sewing machine and a method of obtaining an adjustment of a differential ratio of feeding cloth, in any desired wide range, particularly in an overlock sewing machine by utilizing the method and a device for working this method.

According to the present invention there is provided a mechanism wherein a cloth feeding arm is engaged with a vertically feeding cam fixed to a main shaft and is further connected with an eccentric horizontally feeding cam. The feeding cam comprises a flanged cam member frictionally fixed to the main shaft and an internal surface cam externally fitting it through a link mechanism. The link mechanism comprises a horizontally feeding rocker arm and a horizontally feeding rod arranged so that the horizontal feed of the cloth feeding arm may be simply and freely adjusted by varying the phase of the eccentric double cam with an operating piece which can be operated from outside the sewing machine frame.

The method hereof contemplates setting two of such adjusting mechanisms within a sewing machine frame, each being operated independently of each other, and making the respective adjusted amounts correspond to each other by utilizing the independent adjustment. In accordance herewith there is, also, provided a device for using the method.

Accordingly, it is an object of the present invention to provide a cloth feeding device which is easy to make and wherein the link mechanism is compact.

Another object of the present invention is to provide a cloth feeding device in which the adjustment of the cloth feed is very easy.

A further object of the present invention is to provide a cloth feeding device which can be applied to a differential cloth feed.

Another object of the present invention is to provide a method wherein a differential cloth feed is made by using the cloth feeding device.

A further object of the present invention is to simplify the differential cloth feeding mechanism.

Another object of the present invention is to make a sufficient differential stroke adjustment by a simple operation.

A further object of the present invention is to break the conventional limit of the differential cloth shrinkage and extension.

Another object of the present invention is to obtain a sufficient differential stroke of feeding cloth without overloading rotary coupling surfaces by minimizing the cam eccentricity.

A further object of the present invention is to impart an adjusted sufficient differential stroke by imparting a very slight manual operation to the main shaft.

Another object of the present invention is to fit a horizontally feeding cam for horizontally feeding the main and auxiliary cloth feeding arms to the same main shaft and to rationalize the cam arrangement for the selective adjustment.

A further object of the present invention is to make an entire sewing machine small and light by compacting the differential device for feeding cloth.

The objects can be attained by the means described in the accompanying drawing and the following detailed description.

In the drawing, like reference characters refer to like parts throughout the several views, in which:

DESCRIPTION OF THE PREFERRED EMBODIMENTS

Figure 1:
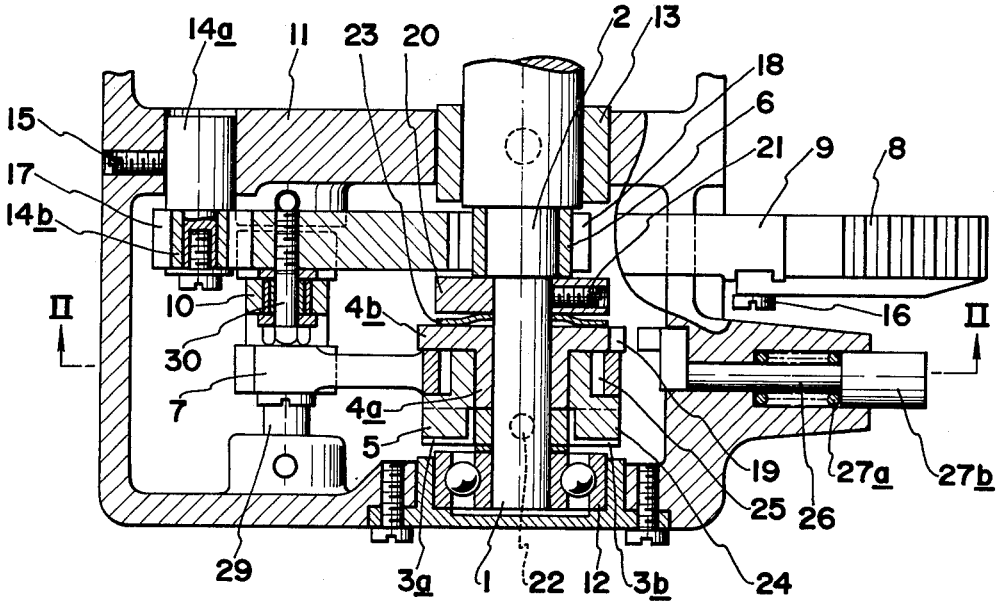
FIG. 1 is sectional plan view of a bed part of sewing machine mechanism.

Now, with reference to the drawing, and in particular FIG. 1, there is depicted a vertically feeding cam 2 and drive means 3*a*, both fixed to a main shaft 1. A flanged eccentric cam member 4*a*, engageable with an adjusting means fitted separately to a sewing machine frame so as to be outside said frame, is fixed to said main shaft by friction. An outer regulating ring member 5, in which the inner peripheral surface is eccentric, is externally fitted to the cam-shaped outer peripheral surface of the flanged cam member 4*a* and engages the drive means 3*a*. The outer regulating ring member 5 is driven by the drive means 3*a*. To this end the ring member 5 includes a clutch 24 and the drive means 3*a* has a notch 3*b* associated therewith. When the rotch 3*b* engages the clutch 24 the outer regulating ring 5 is, thusly, driven. In this respect, the fixed position of the ring member 5 prevents its sliding on the surface of the drive means 3*a* and the external surface of the flanged cam member 4*a*.

Figure 2:
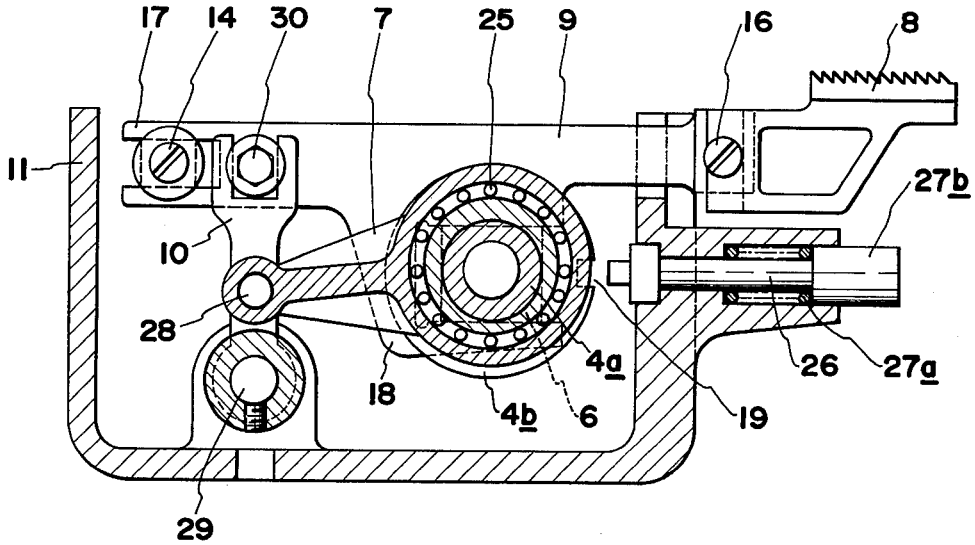
FIG. 2 is a cross-sectional view taken along line II—II of FIG. 1.
Figure 3:
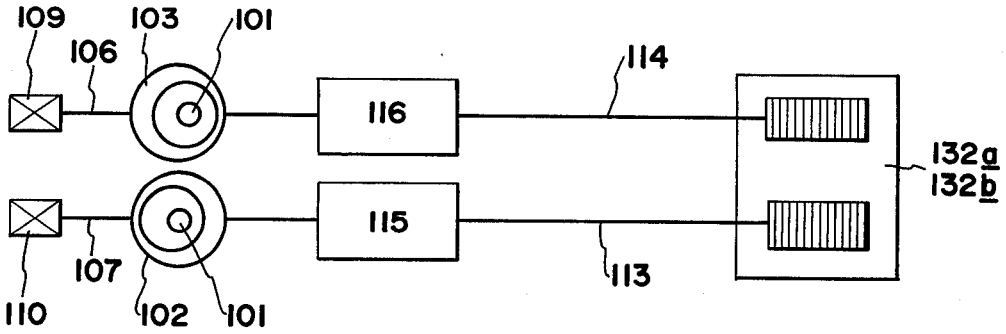
FIG. 3 is a diagram showing a differential method of cloth feeding arms.

Furthermore, according to the present invention, the double cam hereof is defined by coupling the eccentric inner cam member 4*a* and the outer regulating ring member 5. As noted the inner peripheral surface is eccentric or oval. The flanged cam member 4*a* is disposed or set within the inner peripheral surface of the ring member 5 (FIG. 2). Thus, the member 4*a* is tangential to two points of the inner peripheral surface of the ring member 5. By changing the phase of the cam 4*a* the tangent points with the inner oval surface of the ring 5 are, also, altered. In turn, this change in phase moves the ring member in the direction in which the cam member 4*a* projects.

As shown in FIGS. 1 and 2, a horizontal feeding rod 7 is connected to the ring member 5. Therefore, the rod 7 is oscillated horizontally by the flanged cam member 4*a* and the amount of length of the oscillation is regulated by changing the cam phase of the cam member 4*a*.

A cam holding piece 6 is embraced on the outer peripheral surface of the vertically feeding cam 2. Further, a cloth feeding arm 9 having cloth feeding dog 8 is carried so as to be moveable, relatively, with the vertically feeding cam 2 through the cam holding piece 6.

The cloth feeding arm 9 is engaged by a rocker arm 10. The rocker arm 10 is pivoted in the frame so as to rock in oscillatory motion. With more specificity, as shown in FIG. 1, the main shaft 1, which is of known shape, is supported by means, such as a ball bearing 12 and a sleeve 13, within a sewing machine frame 11. A pulley (not shown) is usually fixed to the main shaft 1. However, the main shaft hereof is not limited, solely, to the one depicted in the drawing.

The vertically feeding cam 2 fixed to the main shaft 1 is formed integrally therewith. As shown in FIG. 1, the cam 2 is a so-called "eccentric cam" which can move eccentrically up and down.

As shown in FIG. 1 the cam holding 6 piece embraces the vertically feeding cam 2.

A supporting shaft 14*a* is fixed to project within the machine frame 11. A set screw 15 supports the supporting shaft 14*a*.

The cloth feeding arm 9 is provided at its tip with cloth feeding teeth or dog 8 so as to be adjustable in the vertical direction. A set screw 16 provides the adjustability. The cloth feeding arm 9 has a forked engaging part 17 at the rear end thereof and is provided with a cam embracing arm 18 which projects in the form of an L, below the intermediate part of the cloth feeding arm 9.

The forked engaging part 17 is slidably engaged and carried with the supporting shaft 14*a* through a sleeve 14*b*. The cam embracing arm 18 slidably embraces the cam holding piece 6 of the vertically feeding cam 2. The cloth feeding arm 9 is horizontally disposed within the machine frame 11.

As noted a flanged cam member 4*a* is further fitted to the main shaft 1. The cam 4*a* has a flange 4*b* and a notch 19 formed in the peripheral part of the flange 4*b*.

A collar 20 and the drive means 3*a* are fixed, on the main shaft 1, by fixing screws, 21 and 22.

The flanged cam member 4*a* is pressed in contact with the drive means 3*a* by interposing a dish spring 23 between the collar 20 and the cam member 4*a*. The spring 23 is fixed to the main shaft 1 by friction. In this manner the cam member 4*a* can idle with respect to the main shaft 1 when a stress larger than a fixed size is applied to it but may be as one body with the main shaft 1 in the rotating direction when the stress is smaller than the fixed size.

As noted an outer regulating ring 5, formed as an internal cam surface, is externally fitted to the cam-shaped outer peripheral surface of the cam member 4*a*. The ring 5 and cam member 4*a* cooperate to define or form a double cam, as a whole. The clutch 24 is provided to project on the side surface of the ring opposed to the drive means 3*a*.

The horizontally feeding rod 7 is externally fitted to the outer periphery of the ring 5 through a needle bearing 25.

The notch 19 formed in the flange 4*b* of the cam member 4*a* is engageable with a stopper shaft 26 fitted separately to the machine frame 11. The stopper shaft 26 is resiliently pressed or biassed outward of the machine frame 11 via a spring 27*a* and a push button 27*b* disposed outside the machine frame. The stopper shaft 26, spring 27*a* and push button 27*b* define an adjusting means for the ring 5.

As shown in FIG. 1, the drive means or engaging body 3*a* has the notch 3*b* extending from the peripheral edge toward the center. The clutch 24 of the above mentioned ring 5 is received and engaged with the notch 3*b* so that the ring 5 may be always fixed to the main shaft 1 through the engaging body 3*a*.

The horizontally feeding rod 7 is connected at its other end with the intermediate part, in the longitudinal direction of the rocker arm 10 and is pivoted separately with a shaft 29 within the machine frame through a shaft 28.

The rocker arm 10 is forked at its tip so as to engage with a rocker rod 30 which projects on the side surface of the cloth feeding arm 9. Thus, the horizontally feeding rod 7, rocker arm 10 and cloth feeding arm 9 form a link mechanism for horizontally oscillating the cloth feeding teeth or dog 8.

The cloth feeding device of the this embodiment operates as follows:

When the main shaft 1 rotates, the vertically feeding cam 2 and flanged cam member 4*a* will rotate.

The cloth feeding arm 9 connected with the vertically feeding cam 2 will rock up and down with said cam.

On the other hand, the ring 5, externally fitted to the cam member 4*a*, will rotate integrally with the main shaft 1 together with the clutch 24 and the engaging body 3*a* by the engagement with the notch 3*b*.

In such case, the cam member 4*a* will also rotate integrally with the main shaft 1 due to the frictional locking with the drive means 3*a* and collar 20.

The ring 5 will reciprocate the horizontally feeding rod 7 connected with it. The horizontally feeding rod 7 will reciprocate and rock the rocker arm 10 in an oscillatory motion.

Contemporaneously, the rocker arm 10 will rock the cloth feeding arm 9 in the horizontal direction through the forked part at the tip and the rocker rod 30. The cloth feeding dog 8 formed at the tip of the cloth feeding arm 9 will make a flat elliptic motion in the horizontal direction due to the vertical rocking of the vertically feeding cam 2 and the horizontally feeding operation of the ring 5. This feeding stroke in the horizontal direction determines a so-called cloth feed.

In this embodiment, the push button 27*b* can be pushed against the spring 27*a* so that the stopper shaft 26 may be engaged with the notch 19 formed in the flange 4*b* of the flanged cam member 4*a*.

The cam member 4*a*, which is fixed by friction to the main shaft 1, will be securely fixed to the machine frame by the engagement of the stopper shaft 26 with the notch 19. When the main shaft 1 is rotated by hand, the phases of the cam surface of the outside surface of the cam member 4*a* and the cam surface formed on the inside surface of the ring 5 will deviate from each other. This varies the eccentricity of the cam so that the rocking amount of the horizontally feeding rod 7 may be adjusted. Also, the oscillatory rocking width of the rocker arm 10 may be varied and, finally, the oscillation in the horizontal direction of the cloth feeding arm 9 and cloth feeding dog 8 may be adjusted to the amount of the rocking length of the rocker arm 10.

According to this invention, as the horizontally feeding rod is pivoted to the intermediate part of the rocker arm 10, as mentioned above, the cam adjustment will be amplified by the length of the rocker arm 10. Thus, a sufficient cloth feeding stroke can be adjusted with a very fine cam adjustment to the convenience in the operation.

Further, the structure is simple and the operation can be made from outside the sewing machine frame.

Moreover, the structure is compact and is adaptable to all kinds of sewing machines. The cloth feed adjusting means of the cloth feeding device of this kind can be applied to a wide range of kinds of sewing machines.

By virtue of the present invention, relative to simplicity of structure, it is possible to design a so-called "differential cloth feed." This is achieved by setting, in parallel, two cloth feeding arms with a differential stroke sufficient in the adjustment of the differential cloth feed, so that differential main and auxiliary cloth feeding teeth may operate to sufficiently shir and tension the cloth.

Thus, and according to the present invention, there is provided a method and device wherein an adjustment of differential feeds in a wide range can be made by reasonably combining two cloth feed adjusting devices in which double cams are used.

According to the present method, and with reference to FIGS. 3–6, generally, two double cams 102 and 103 are fitted to a main shaft 101 so as to be, respectively, separately adjustable. One double cam 102 is adjusted in the range from the maximum eccentricity to zero eccentricity. The adjustment is made independently from outside the sewing machine frame. The other double cam 103 is adjusted in the range from zero eccentricity to the maximum eccentricity independently from outside the sewing machine frame. In this manner the main cloth feeding arm 113 and auxiliary cloth feeding arm 114 corresponding, respectively, separately to the double cams 102 and 103 may be, respectively, operated by their respective double cams to obtain any desired differential ratio of feeding cloth in an overlock sewing machine. Thus, the differential cloth feeding method of this invention is characterized by using two double cams as combined to be opposed to each other.

With more specificity, the two double cams 102 and 103 are fitted to main shaft 101 and are, respectively, separately phase adjusted to determine their respective eccentricities. In adjusting the phases of the double cams 102 and 103, either of the inside and outside cam members of each double cam is driven by the main shaft 101. Concommitantly, the other cam member is locked by its independent corresponding stopper shaft 106 or 107, which can be operated from outside the sewing machine frame, as hereinbefore described. The phases of the coupled surfaces of the inside and outside cam members are varied by manually rotating the main shaft 101.

The eccentric rotations of the double cams 102 and 103, having had their respective eccentricities set, are transmitted, respectively, to the main and auxiliary cloth feeding arms 113 and 114 by proper connecting means aassociated therewith.

The phases of the double cams 102 and 103 are set in the range from maximum eccentricity to zero eccentricity. In differentiating the main cloth feeding arm 113 and auxiliary cloth feeding arm 114 and in order to make the differential amount large or, preferably, maximum, the eccentricity of double cam 102 is made maximum and that of double cam 103 is made zero.

Needless to say, the eccentricity of double cam 103 can be made maximum and that of double cam 102 can be made zero. In such case, the differential feeds by the main and auxiliary cloth feeding arms 113 and 114 will be reversed so that extended sewing is possible.

It is, also, possible to freely combine the eccentricities of the double cams 102 and 103 in the range from maximum to zero. In such case, it is, also, possible to make the eccentricities of the double cams in an equal ratio. In such case, the feed of the cloth will be set only by the eccentricity and, thus, will not be a differential feed, but an ordinary feed.

Thus, in the method of the present invention, the main and auxiliary cloth feeding arms are adjusted and driven separately, as opposed to each other, at a ratio, by two double cams opposed to each other, and are independently adjustable so that a differential ratio may be easily obtained.

It is to be noted that the normal and reverse switching adjustment of the differential feeding can be made by exactly the same operation as in the ordinary differential adjustment so that a so-called "extended sewing" may be made easily and sufficiently.

Furthermore, an ordinary cloth feeding, which is not a differential feeding, can be adjusted exactly the same by making the eccentricities of the two double cams equal to each other. The adoption of such two double can systems results in generally simplifying the mechanism of the differential adjustment of the cloth feeding.

Thus, according to the present method, a sufficient differential cloth feeding: a differential cloth feeding of a sufficient normal and reverse switching and, an adjustment of a non-differential cloth feeding can be made by such simple means as a push button outside the sewing machine frame.

Figure 4:
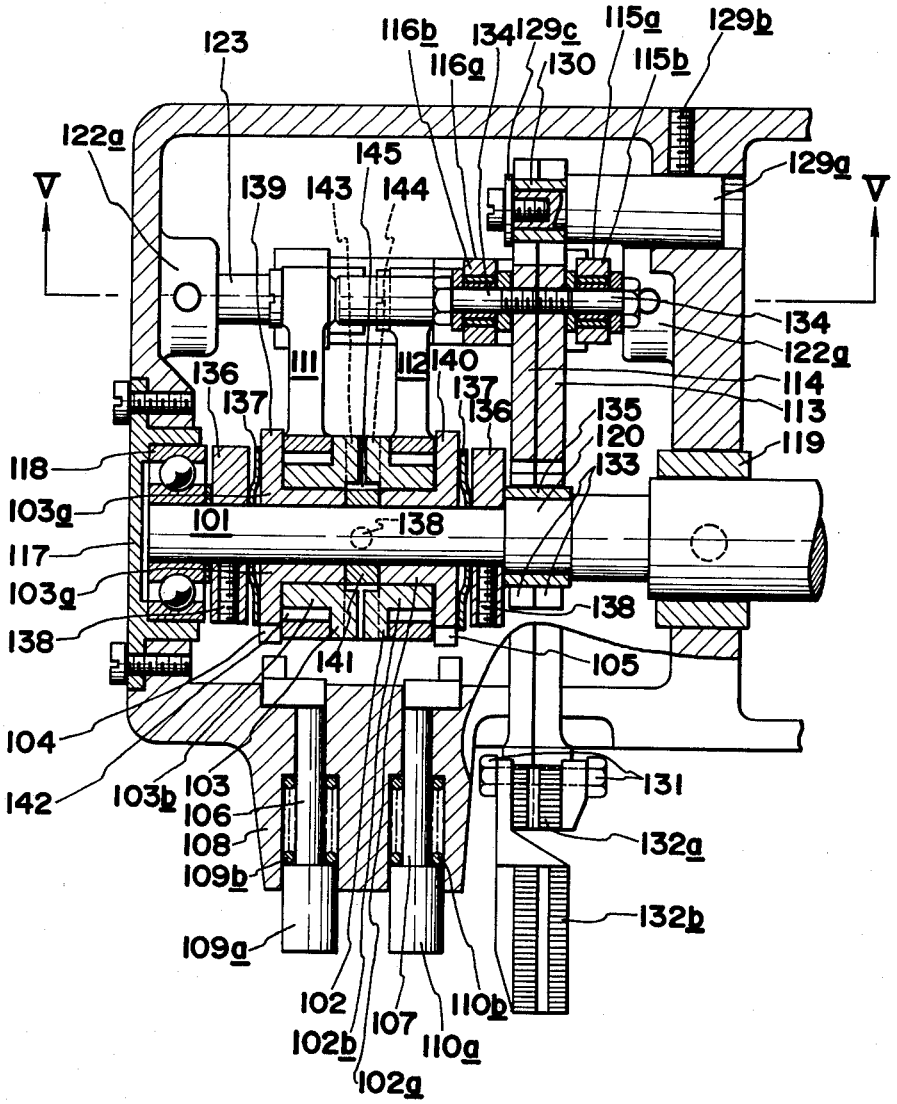
FIG. 4 is a sectional plan view below the bed of an over-lock sewing machine having a differential cloth feeding device.

Referring now, specifically, to FIG. 4, there is depicted apparatus for carrying out the method.

In accordance herewith, two double cams 102 and 103 are fitted to a main shaft 101. Either of the inside or outside cam members of each of the double cams 102 and 103 is frictionally fixed to the main shaft 101. The fixed cam member is provided with an engaging notch 104 or 105 for stopping the rotation which can deviate the coupling surfaces, by friction, against the rotation of the main shaft 101. Two stopper shafts 106 and 107, each of which can be independently engaged and which are each independently set or mounted in the frame 108 are opposed to their respective, engaging notches 104 and 105 for stopping the rotation of associated cams 103*a* and 102*a*. The stopper shafts 106 and 107 are each connected with independent push buttons 109*a* and 110*a* arranged on the outside surface of a machine frame 108. The push buttons are opposed to each other.

Opposed horizontally feeding rods 111 and 112 are externally fitted to their respective double cams 102 and 103. The horizontally feeding rods 111 and 112 are connected at their other ends to the intermediate positions in the longitudinal direction of horizontal rocker arms 115*a* and 116*a*. Each rocker arm 115*a* and 116*a* is pivoted at one end thereof and connected at their other ends separately correspondingly with main and auxiliary cloth feeding arms 113 and 114.

Figure 5:
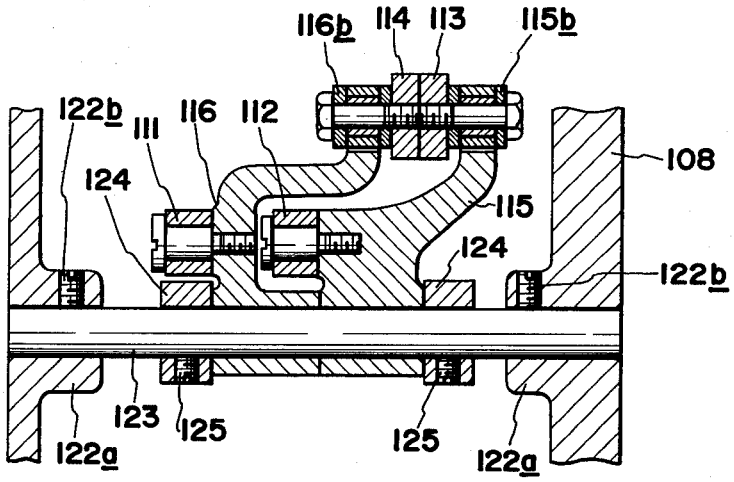
FIG. 5 is a cross-sectional view taken along line V—V of FIG. 4.

As shown in FIG. 4 and FIG. 5, a thrust plate 117 is threadably secured to the outside surface of the sewing machine frame 108 and holds a ball bearing 118 on its inside surface. A bearing sleeve 119 opposed to the ball bearing 118 is fitted within the machine frame 108. The main shaft 101 is carried by the ball bearing 118 and bearing sleeve 119. A vertically feeding cam 120 and a drive means 141 are fixed to the main shaft 101.

The vertically feeding 120 is formed a little wider than the combined thickness of the main and auxiliary cloth feeding arms.

Opposed bosses 122*a* are disposed within the sewing machine frame 108. A pivot shaft or pivot 123 is interposed between the bosses 122*a* and is substantially parallel to the main shaft 101.

Figure 6:
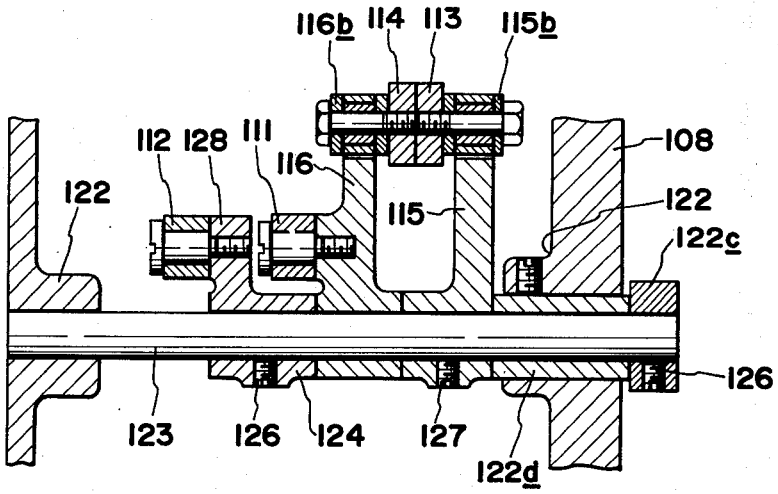
FIG. 6 is a sectional view of an alternate embodiment of the part shown in FIG. 5.

FIGS. 5 and 6 show two embodiments of the details of the pivot 123.

Referring to FIG. 5, a pair of spaced apart collars 124 are fixed to the pivot 123, via means, such as a fixing screw 125 therefor. Two horizontal rocker arms 115 and 116 are fitted between the collars 124 on the pivot 123. Th pivot 123 is fixed to the bosses 122*a* and the horizontal rocker arms 115 and 116 are freely rotatably fitted thereon. A fixing screw 122*b* is provided for the pivot.

The horizontal rocker arms 115 and 116 are configured in the form of a crank and are forked at the tips. Each of the horizontally feeding rods 111 and 112 is pivoted at one end with a pin between the first bent part and the pivoting part.

The embodiment of FIG. 6 is the same as that of FIG. 5 in that the rocker arm is forked at the tip but differs therefrom in that the pivot 123 is freely rotatable with respect to the bosses 122. A collar 122*c* is fixed to the pivot 123 with a screw 126 which prevents the pivot 123 from escaping in the axial direction with respect to the sewing machine frame. A bearing sleeve 122*d* has one end of the pivot 123 extending therethrough.

In this embodiment one horizontal rocker arm 115 is fixed to the pivot 123 with a screw 127 and is in contact with one end surface of the boss 122. Another horizontal rocker arm 116 is rotatably fitted to the pivot 123. The horizontally feeding rod 111 is pivoted to the intermediate part in the longitudinal direction of the horizontal rocker arm 116 rotatably fitted to the pivot 123.

The embodiment of FIG. 6 further includes a combined collar and crank bar denoted at 128.

The crank bar 128 is fixed to the pivot 123 with a screw 126 so as to press the horizotal rocker arm 116 on the side surface and to rotate the pivot 123. The tip of the crank bar 128 is formed just at the length positioned in the intermediate part in the longitudinal direction of the horizontal rocker arm 116 and the horizontally feeding rod 112 is pivoted to this tip so that the two horizontal rocker arms 115 and 116 are substantially linear.

Both of the embodiments of FIGS. 5 and 6 are adapted to adjust the positioning of the horizontally feeding rod and cloth feeding arm, in a manner to be described subsequently.

Referring again to FIG. 4, a supporting shaft 129*a* is fixed to project in the sidewise position in the diametral direction of the vertically feeding cam 120 in the machine frame 108 and has a sliding sleeve 130 fitted to it.

The main and auxiliary arms 113 and 114 are similarly shaped and each have main and auxiliary cloth feeding teeth 132*a* and 132*b* vertically adjustably fitted to their respective tips with fixing screws 131 at one end thereof. The rear ends of arms 113 and 114 are forked in the same manner as in the embodiment in FIG. 1. The rear ends of arms 113 and 114 are engaged in the forked parts with the supporting shaft 129*a* so as to embrace the sliding sleeve 130. A stopper 129*c* is also provided.

The main and auxiliary cloth feeding arms 113 and 114 are provided with L-shaped cam embracing arms 133 projecting below in the same manner as in the embodiment in FIG. 1. The rocking arms, also, include rocker pins 134 disposed on the outside surfaces opposite the sides opposed to each other. The arms engage and hold the rocker pins 134 by the provision of the forked parts 115*b* and 116*b* at the upper ends of the horizontal rocker arms 115*a* and 116*a* but which permit the vertical sliding of the rocker pins 134 for escapements.

The cloth feeding arms 113 and 114 are, thus, arranged and are slidably engaged and carried each at one end by the supporting shaft 129*a*.

At the other end, a cam holding piece 135 is fitted to vertically feeding cam 120 and is fixed to the main shaft 101 so as to embrace it.

The main and auxiliary cloth feeding arms 113 and 114 are carried by the vertically feeding cam 120 as slidably held so as to hold the cam holding piece 135 with the L-shaped cam embracing rods 133.

The main and auxiliary cloth feeding arms 113 and 114 are arranged and are carried between the supporting shaft 129 and vertically feeding cam 120.

Still referring to FIG. 4, collars 136 are fixed at a proper spacing to the main shaft 101 and the drive means 141 is fixed intermediate the collars, via a stopper screw 138.

The collars 136 are adjustable in the axial direction of the main shaft 101. Biassing means, preferably, or dish springs 137 are fitted to the main shaft 101 respectively on the side surfaces facing the respective collars 136.

Further, double cams 102 and 103 are fitted to the main shaft 101 on the side surfaces of the dish springs 137 facing each other. The double cams 102 and 103 each comprise inside flanged cam members 102*a* and 103*a* and outside regulating rings or cam members 102*b* and 103*b*, respectively.

The cam members 102*a* and 103*a* each have respective flanges 139 and 140 in contact with the associated dish springs 137. Engaging notches 104 and 105 for stopping rotation are formed on the peripheral edges of flanges 139 and 140, respectively. The shapes of the engaging notches for stopping the rotation can be of any desired configuration. However, their shape is determined by engaging rods, hereinafter described, which are fitted separately to the sewing machine frame 108. In FIG. 4 the flanges 139 and 140 are cut on their peripheral edges to form the notches.

The outer peripheral surfaces of the sleeves of the cam members 102*a* and 103*a* are formed as eccentric cams. The cam members 102*a* and 103*a* are frictionally fixed and cooperate with the collars 136 and dish springs 137 to hold the drive means 141. The cam members 102*a* and 103*a* are temporarily fixed to the main shaft by the engaging force defined by the resiliency and friction coefficient. The temporary fixing degree can be adjusted to be high or low by adjusting the positions of the collars 136.

The outside cam members 102*b* and 103*b* are externally fitted to the cam surfaces of the flanged cam members 102*a* and 103*a* so as to couple with the cam surfaces of the respective inside cams. The inside surfaces of the respective cam members 102*b* and 103*b* are formed as eccentric cams. The horizontally feeding rods 111 and 112 are externally fitted to the outside surfaces of the eccentric cams through needle bearings 142. Clutches 143 and 144 are provided respectively on the side surfaces of the cam members 102*b* and 103*b* facing the drive means 141.

Figure 7:
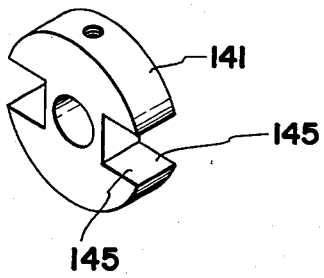
FIG. 7 is a perspective view of an engaging piece.

As shown in FIG. 7, the drive means 141 is a rather thick disc. The drive means 141 functions for both outside cam members 102*b* and 103*b*. The drive means 141 has notches formed over the entire thickness thereof extending from the peripheral edge toward the center. Thus, there are provided engaging notches 145 substantially on both surfaces of the piece.

The clutches 143 and 144 associated with the outside cam members 102*b* and 103*b* are inserted and engaged with the notches 145 from both surfaces of the drive means 141.

Thus, the outside cam members 102*b* and 103*b* are fixed to the main shaft 101 through the drive means 141.

It should be noted that the drive means may comprise separate pieces corresponding respectively to the outside cam members. In such instance, engaging parts are formed only on the side surfaces facing the respective outside cam members and the two engaging pieces are then, combined to form the drive means having engaging parts substantially on both surfaces. Furthermore, the engagement of the drive means with the cam members is not limited solely to that described above. However, the engagement described herein is preferred because of its simplicity.

Referring again to FIG. 4, stopper shafts 106, 107 are fitted to the machine frame 108. The stoppers are adjacent to and parallel with each other, and extend through the machine frame. Push button type operating pieces 109*a*, 110*a* are mounted on the machine frame and are resiliently pressed outward by springs 109*b* and 110*b* within the thickness of the machine frame.

The stopper shafts 106, 107 are opposed at their tips to the engaging notches 104, 105 formed on the flanges 139 and 140 of the cam members 102*b* and 103*b*. The stopper shafts 106, 107 are adapted to engage the rotation stopping engaging notches 104 and 105 by pressing the push button type operating pieces 109*a* and 110*a*.

It is to be appreciated that the present invention enables the manufacture of small sewing machines with a wide range differential adjustment including the normal and reverse adjustment. This is achieved by opposing the independently operating push button type operating pieces 109*a* and 110*a* to the double cams 102 and 103 fitted to the main shaft 101 in the direction intersecting the main shaft 101. This is based on the positional relationship by which two operating pieces 109*a* and 110*a* can be projected on the machine frame surface facing the operator. The combination of the positional relationship and the two double cams enable the manufacture of small sewing machines while making a wide range of differential adjustment easy.

The differential cloth feeding device of FIG. 4 operates as follows:

When the main shaft 101 rotates, the vertically feeding cam 120 and the double cams 102 and 103 will rotate. The main and auxiliary cloth feeding arms 113 and 114 will be rocked up and down by the vertically feeding cam 120. Contemporaneously, the cloth feeding arms 113 and 114 will be rocked in the horizontal direction through the horizontally feeding rods 111 and 112 by the double cams 102 and 103, respectively. Thus, the cloth feeding teeth or dogs 132*a* and 132*b* will make a flat elliptic motion in the horizontal direction.

Since the horizontally feeding rods 111 and 112 are connected from the double cams 102, 103 to the intermediate parts of the horizontal rocker arms 115, 116 along the longitudinal extent thereof, so as to intersect each other at the tips, even if the eccentricities of the double cams 102 and 103 are very small, the rocking amounts of the horizontal rocker arms 115 and 116 will be amplified and the rocker arms will be able to oscillatorily rock to form a sufficient cloth feeding stroke.

Now, if the push button type operating pieces 109*a* and 110*a* are selectively pushed against the springs 109*b* and 110*b* so as to selectively project the stopper shafts 106 and 107, respectively, into the machine frame, the stopper shafts 106 and 107 will selectively engage with the engaging notches 104 and 105 for stopping the rotation formed on the flanges 139 and 140 of the cams 102*a* and 103*a*, respectively. Thus, the cams 102*a* and 103*a* will be selectively securedly fixed to the machine frame.

If the main shaft 101 is rotated by hand, the coupled phases of the cam surfaces of the sleeve-shaped cams 102*a* and 103*a* and the outside cam members 102*b* and 103*b* will vary. Meanwhile, the outside cam members 102*b* and 103*b* of the double cams 102 and 103, respectively, are fixed to the main shaft 101 through the drive means 141 and the selected one of the flanged cam members 102*a* and 103*a* is fixed to the machine frame 108 through the stopper shaft 106 or 107. In this manner the eccentricities of the selected double cams 102 and 103 will vary and the horizontal feed will be adjusted.

According to the method of the present invention, as mentioned above, a sufficient cloth feeding differential stroke can be obtained with cams of small eccentricities. Particularly, the operation of adjusting the working device is very simple. Further, the device is simple in the structure. Furthermore, the formation of the cam link can be contained in a small space so as to contribute to making the formation of the sewing maching small and the precision of the operation and durability of the device high.

What is claimed is:

1. A cloth feeding device for a sewing machine, comprising:

a. a main shaft, b. a vertically feeding cam fixed to the main shaft, c. a driving means fixed to the main shaft, d. a flanged cam frictionally mounted on the main shaft, and being engageable with an external adjusting means, e. an outer regulating ring having an eccentric inner peripheral surface externally fitted to the outer peripheral surface of the flanged cam, the flanged cam and the ring cooperating to define a double cam, the ring engaging and being driven by the drive means, f. a cam holding piece embracing the vertically feeding cam, g. a horizontally feeding arm connected to the ring, h. a cloth feeding arm having a cloth feeding dog carried by the cam holding piece and being movable with the vertically feeding cam, i. a pivotally mounted rocker arm, the rocker arm rocking oscillatorily and engaging the cloth feeding arm, and wherein the horizontally feeding arm is pivoted to the intermediate part of the rocker arm along the longitudinal axis thereof.

2. The device of claim 1 wherein the sewing machine is an overlock sewing machine, the cloth feeding device being a differential device and which further comprises:

a. a pair of double cams, either the ring or flanged cam of each of which is frictionally fitted to the main shaft, each double cam including an engaging part for stopping rotational deviation between the coupled surface of the double cams, b. a pair of stopper shafts, each member of the pair being associated with one of the pair of double cams, the stopper shafts being independently engageable with and opposed to the engaging part associated with the respective double cam, c. independently operable push buttons, one for each of the stopper shafts and being connected thereto, the push buttons disposed on the outside of the sewing machine, each stopper shaft and associated push button defining external adjusting means, d. a pair of corresponding horizontally feeding rods, each associated with and externally fitted to one of the rings of the double cams at one end thereof, e. a pair of horizontal rocker arms, each being pivotally mounted at one end thereof, the other ends of the feeding rods being connected to one of the rocker arms intermediate the longitudinal axis thereof, and f. a pair of cloth feeding arms, one cloth feeding arm defining a main arm and the other defining an auxiliary arm, the other ends of the rocker arms being connected to one of the cloth feeding arms.

3. The cloth feeding device of claim 1 wherein the device is a differential device and which further comprises:

a. a main feeding cloth arm having a cloth feeding dog, b. an auxiliary feeding cloth arm having a cloth feeding dog, c. a pair of corresponding pivotally mounted rocker arms, each being associated with and engaging one of the feeding cloth arms in the intersecting direction, d. the drive means having engaging notches on both its front and back surfaces, e. a pair of opposed flanged cams having cam surfaces on their outside surfaces, the flanged cams being frictionally temporarily fixed to the main shaft, the drive means being disposed between the two flanged cams, f. a stopper shaft for each flanged cam, the stopper shafts being engageable with the engaging notches, g. a pair of rings in which the inside surface of each is eccentric, each ring being externally fitted to one of the flanged cams such that the cam surfaces face each other, each flanged cam and ring defining a double cam, each double cam being engaged solely with the drive means, and each of the feeding arms being associated with one of the double cams, the feeding arms being fitted to the associated ring of the double cams, at one end thereof and to an associated rocker arm at the other end thereof, the feeding arms being connected to the rocker arms intermediately thereof along the longitudinal axis.

4. The device of claim 3 wherein:

a. the ends of the rocker arms intersecting the cloth feeding arms are forked, the rocker arms being secured to the feeding arms with rocker pins disposed at the forked ends, the forked ends and rocker pins defining means for engaging the rocker arms and the feeding arms, b. each of the flanged cams are temporarily fixed to the main shaft by means comprising:

1. a collar axially adjustably mounted on the main shaft, and
2. biassing means secured to the main shaft adjacent the collar, the biassing means resiliently pressing against the flanged cam, the drive means being disposed between the means for temporarily fixing the flanged cams, c. each ring comprises a horizontal feeding cam, and d. a clutch associated with each double cam, the clutch engaging the engaging notches of the drive means to interconnect the ring to the drive means.

5. A method for varying the cloth feeding differential ratio for an overlock sewing machine, comprising:

a. mounting two separately, independently adjustable double cams on the main shaft of the sewing machine, b. indenpendently adjusting one of the double cams in a range from zero eccentricity to maximum eccentricity exteriorly of the sewing machine, and c. separately operating a main cloth feeding arm and an auxiliary cloth feeding arm through a respective double cam associated therewith.

* * * * *